US007596978B2

(12) United States Patent
Hoelzel et al.

(10) Patent No.: US 7,596,978 B2
(45) Date of Patent: Oct. 6, 2009

(54) BLASTING DEVICE

(75) Inventors: Falko Hoelzel, Berlin (DE); Jean Müller, Berlin (DE); Michael Pape, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/082,434

(22) Filed: Apr. 11, 2008

(65) Prior Publication Data

US 2008/0295557 A1 Dec. 4, 2008

(30) Foreign Application Priority Data

Apr. 12, 2007 (EP) ..... 07007545

(51) Int. Cl.
*B21D 31/06* (2006.01)
*B24C 1/00* (2006.01)

(52) U.S. Cl. ..... 72/53; 451/39; 451/40

(58) Field of Classification Search ..... 72/53; 451/38–40

See application file for complete search history.

(56) References Cited

U.S. PATENT DOCUMENTS

| | | | | |
|---|---|---|---|---|
| 6,336,844 | B1 * | 1/2002 | Duquenne et al. | 451/36 |
| 6,490,899 | B2 * | 12/2002 | Berthelet et al. | 72/53 |
| 6,505,489 | B2 * | 1/2003 | Berthelet et al. | 72/53 |
| 6,508,093 | B2 * | 1/2003 | Berthelet et al. | 72/53 |
| 6,837,085 | B2 * | 1/2005 | Berthelet et al. | 72/53 |
| 7,389,663 | B2 * | 6/2008 | Cheppe et al. | 72/53 |
| 2006/0021410 | A1 * | 2/2006 | Cheppe et al. | 72/53 |

* cited by examiner

*Primary Examiner*—David B Jones

(57) ABSTRACT

Disclosed is a blasting device for blasting a part of a turbine blade, which has a blade root, a blade platform and a blade airfoil, with a blasting cubicle, which has an insertion opening, a blasting unit for the discharge of accelerated blasting media into the blasting cubicle, and a mounting for the turbine blade, wherein a seal is provided, which seals a gap between the mounting and the blade airfoil in the region of the insertion opening and so prevents the escape of dust, which is created when blasting, from the blasting cubicle, and wherein the seal seals the gap from the inner side of the cubicle.

15 Claims, 1 Drawing Sheet

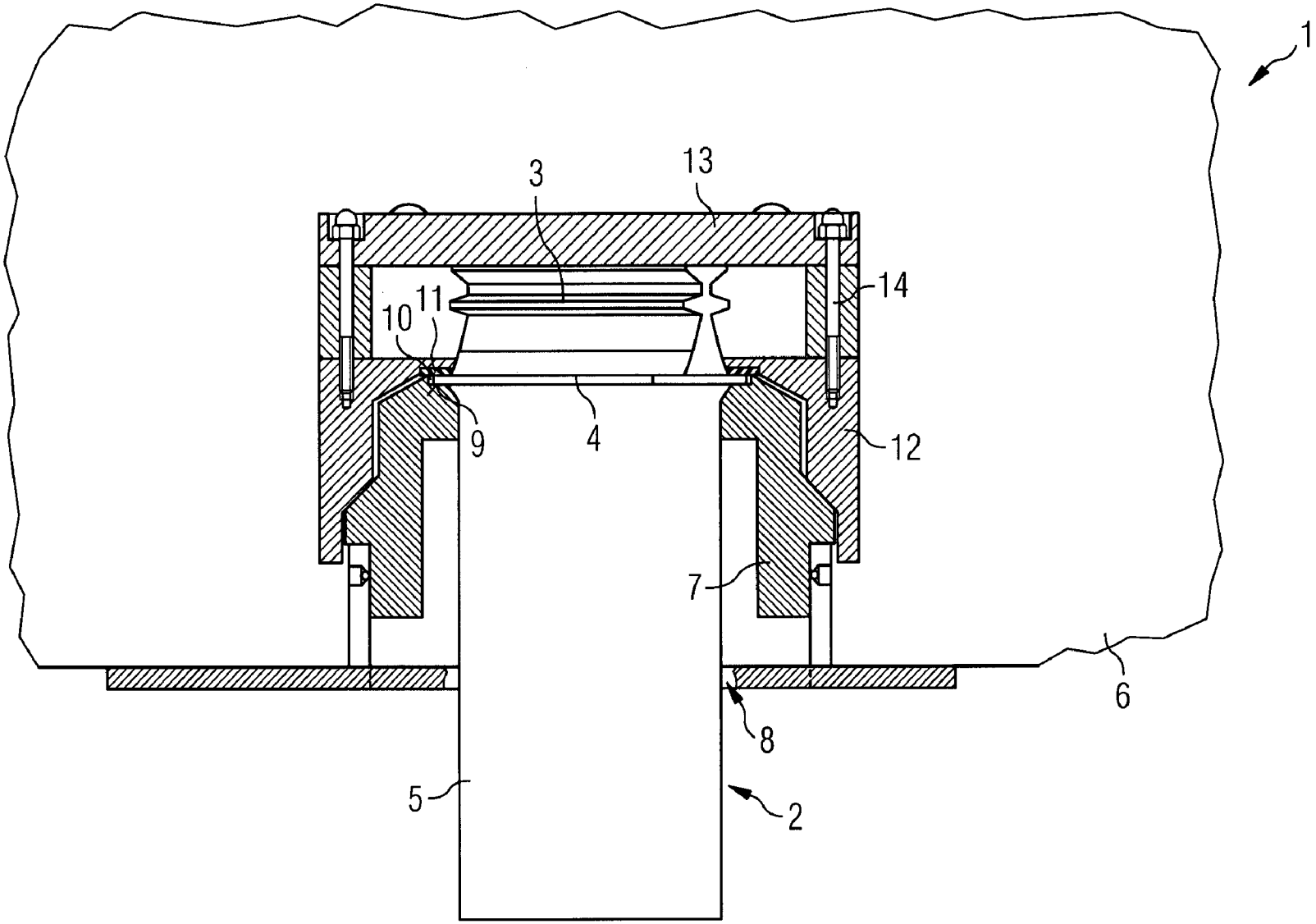
1
6
14
12
13
2
8
7
4
3
9
11
10
5

BLASTING DEVICE

CROSS REFERENCE TO RELATED APPLICATIONS

This application claims the benefits of European application No. 07007545.2 filed Apr. 12, 2007 and is incorporated by reference herein in its entirety.

FIELD OF INVENTION

The present invention relates to a blasting device for blasting a part of a turbine blade, which has a blade root, a blade platform and a blade airfoil, with a blasting cubicle which has an insertion opening, a blasting unit for the discharge of accelerated blasting media into the blasting cubicle, and a mounting for the turbine blade, wherein a seal is provided, which seals a gap between the mounting and the blade airfoil in the region of the insertion opening and so prevents the escape of dust, which is created when blasting, from the blasting cubicle.

BACKGROUND OF THE INVENTION

Such a blasting device is described in US 2006/0021410 A1. This device is provided for blasting the blade root and the side of the blade platform of a turbine blade which faces the blade root. For this purpose, it has a blasting cubicle which is provided with an insertion opening through which the part of the turbine blade which is to be blasted can be introduced into the blasting cubicle. Furthermore, a mounting is provided, which fixes the turbine blade in the inserted state. The mounting is provided with seals which, from the outer side of the cubicle, seal a gap which is formed between the blade platform and the mounting.

A significant problem when blasting turbine blades is that the dust which is created in the course of this can escape from the cubicle and can get onto the ceramic coating of the blade airfoil. As a result of this, its function and service life is negatively affected.

With the previously known device, seals are provided in order to prevent the escape of dust from the chamber. The seals are fastened at the bottom end of the mounting and so are designed for sealing the gap on the cubicle's outer side. However, this construction does not offer sufficient assurance that the cubicle is closed off in an altogether dustproof manner.

SUMMARY OF INVENTION

It is, therefore, the object of the present invention to create a blasting device in which the escape of dust from the blasting cubicle is effectively prevented.

This object is achieved with a blasting device of the type mentioned in the introduction by the seal sealing the gap from the inner side of the cubicle.

Since the seal according to the invention is arranged on the inner side of the cubicle, the penetration of dust into the gap is already effectively prevented. In this way, it is ensured that no dust from the cubicle can get to the blade airfoil.

According to a first embodiment of the invention, the mounting can have a locating surface upon which the surface of the blade platform which points away from the blasting cubicle at least partially bears. In this case, it is advantageous that the turbine blade undergoes an additional stabilization in the mounting.

The mounting can also be formed in order to hold the turbine blade in a vertically suspended manner. In this case, the gravity force contributes to the stabilization of the turbine blade in the mounting.

A cap, which on the inner side of the chamber fits over the blade platform and the seal, can also be provided. The cap advantageously protects the seal against the blasting media which is present in the cubicle. As a result of this, in particular the service life of the seal is increased, since this is no longer worn away during the blasting process.

In order to ensure a secure connection between the cap and the mounting, the two components can be interconnected by means of a fastening device. For example, screws or clamping devices of various types are suitable for this. When clamping the components, the seal which lies between them is compressed and so is pressed into the gap between the mounting and the blade platform, as a result of which the degree of sealing is further increased.

It is also possible to provide for the seal to be fastened on the cap. As a result of this, a quick, accurate and simultaneous assembly of the cap and of the seal is possible. Furthermore, slipping of the seal is prevented. In order to facilitate the exchange and the maintenance of the seal, it can especially be detachably fastened on the cap.

The part of the turbine blade which is to be blasted can be formed at least by its blade root and, if applicable, by regions of the side of the blade platform which face the blade root.

In this case, the blasting device can have a cover element which bears upon the underside of the blade root which lies at the top in the suspended state. If the turbine blade has cooling air holes, the associated air inlet holes of the cooling air passages are located in the underside of the blade root. Since the cooling air passages are frequently provided with sensitive coatings, it is necessary to prevent the penetration of dust during the blasting process. According to this embodiment of the invention the air inlet holes are closed off by the cover element.

Clamping elements can be provided, which enable clamping of the cover element to the cap and/or to the mounting. As a result of this, on the one hand the cover element is fixed in its spatial position, and on the other hand the turbine blade is clamped in the mounting.

A large-pore foam can be used as sealing material. This material is especially suitable since on the one hand it ensures high sealing integrity, and on the other hand has a sufficient resistibility and therefore also a long service life.

The seal can be 1 to 15 mm thick. If the seal is less than 1 mm thick, there is the risk of inadequate sealing, whereas seals with a thickness of more than 15 mm are susceptible to wear. It has been shown that thicknesses of 2 to 10 mm, and especially 0.5 mm, are suitable to ensure high sealing integrity with simultaneously low wear.

In order to still further reduce the risk of escape of dust from the cubicle, a suction device can also be provided. This continuously removes the dust which is created from the cubicle.

BRIEF DESCRIPTION OF THE DRAWINGS

The invention is explained in more detail in the following, based on an exemplary embodiment with reference to the attached drawing.

In the drawing:

FIG. 1 shows a schematic representation of a blasting device according to the invention.

DETAILED DESCRIPTION OF INVENTION

In FIG. 1, a schematic representation of a blasting device 1 according to the invention for blasting a part of a turbine blade 2 is shown. The turbine blade 2 comprises a blade root 3, a blade platform 4 and a blade airfoil 5.

The blasting device 1 has a blasting cubicle 6, a blasting unit, which is connected to it, but not shown, for the discharge of accelerated blasting media, and a mounting 7 for the turbine blade 2.

An insertion opening 8 is formed in the blasting cubicle 6, through which is guided the blade airfoil 5 of the turbine blade 2. The mounting 7 is arranged inside the blasting cubicle 6, surrounding the insertion opening 8, wherein it holds the turbine blade 2 in a vertically suspended manner. For this purpose, a locating surface 9 is formed on the mounting 7, upon which the surface of the blade platform 4 which points away from the blasting cubicle 6 bears in areas. As a result of this, a gap 10, which extends to the insertion opening 8, is formed between the mounting 7 and the blade platform 4. This gap 10 is sealed on the inner side of the cubicle by means of a seal 11 which consists of a large-pore foam and is 1 to 15 mm thick.

The blasting device 1 also has a cap 12 which on the inner side of the cubicle fits over the blade platform 4 and the seal 11. In this way, the seal 11 is advantageously protected against the blasting media, which increases its service life.

The seal 11 can be detachably fastened on the cap 12. Furthermore, the mounting 7 and the cap 12 can be interconnected via a fastening device which is not shown.

A cover element 13 bears upon the upper-lying underside of the blade root 3. It is clamped to the cap 12 via clamping elements 14 which in this case are formed as spring retainers, and so is fixed in its spatial position. In doing so, the cover element 13 closes off air inlet holes which are formed in the blade root 3, but not shown. If the mounting 7 is connected to the cap 12 via the fastening device, the blade root is clamped at the same time.

In order to blast the turbine blade 2 by the blasting device 1, blasting media is discharged at high speed into the blasting cubicle 6 from the blasting unit for the discharge of accelerated blasting media. This blasting media impinges upon the uncovered regions of the blade root 3 and of the blade platform 4. In doing so, dust is formed, which, however, is stopped from penetrating into the air inlet holes of the cooling air passages by means of the cover element 13. Furthermore, the seal 11 prevents the dust from penetrating into the gap 10, so that the blasting cubicle 6 is closed off in a totally dustproof manner in relation to the environment. As a result, it is ensured that no dust from the blasting cubicle 6 can get onto the blade airfoil 5.

The invention claimed is:

1. A blasting device for blasting a part of a turbine blade having a blade root, a blade platform and a blade airfoil, comprising:

a blasting cubicle having an insertion opening configured such that the blade airfoil is arranged partially inside and partially outside the blasting cubicle;

a blasting unit that discharges accelerated blasting media into the blasting cubicle;

a mounting arranged inside the blasting cubicle and surrounding the insertion opening, where the mounting receives the turbine blade;

a seal arranged between the mounting and a platform of the turbine blade, where the seal seals a gap, from the inner side of the cubicle, between the mounting and the blade platform in a region of the insertion opening and prevents an escape of dust created during blasting; and a cap arranged on an inner side of the cubicle that fits over the blade platform and the seal such that the seal is protected against the blasting media.

2. The blasting device as claimed in claim 1, wherein the mounting has a locating surface that at least partially contacts a surface of the blade platform that points away from the blasting cubicle.

3. The blasting device as claimed in claim 2, wherein the mounting suspends and holds the turbine blade.

4. The blasting device as claimed in claim 1, wherein the cap and the mounting are interconnected via a fastening device.

5. The blasting device as claimed in claim 1, wherein the seal is detachably fastened on the cap.

6. The blasting device as claimed in claim 5, wherein a part of the turbine blade to be blasted is at least a blade root.

7. The blasting device as claimed in claim 6, wherein a part of the turbine blade to be blasted further includes regions of a side of the blade platform that face the blade root.

8. The blasting device as claimed in claim 7, further comprising a cover element that covers an underside of the blade root which closes off an air inlet holes of the blade root.

9. The blasting device as claimed in claim 8, further comprising:

a plurality of clamping elements that clamp the cover element to the cap and to the mounting, or a plurality of clamping elements that clamp the cover element to the cap or to the mounting.

10. The blasting device as claimed in the claim 9, wherein the seal is a large-pore foam.

11. The blasting device as claimed in claim 10, wherein the seal is 1 to 15 mm thick.

12. The blasting device as claimed in claim 11, wherein the seal is 2 to 10 mm thick.

13. The blasting device as claimed in claim 12, wherein the seal is 5 mm thick.

14. The blasting device as claimed in claim 11, further comprising a suction device in communication with the blasting cubicle that withdraws dust created during blasting.

15. The blasting device as claimed in claim 1, wherein the blasting cubicle, the blasting unit and the mounting are configured such that an entirety of a blade root is accessible by the accelerated blasting media.

* * * * *